United States Patent [19]

Masimo et al.

[11] Patent Number: 5,030,944

[45] Date of Patent: Jul. 9, 1991

[54] DISPLAY APPARATUS WITH ROTATABLE DISPLAY SCREEN

[75] Inventors: Tamon Masimo, Hiratsuka; Hiroshi Kanazawa, Yokohama; Hidefumi Masuzaki; Satoshi Ito, both of Odawara, all of Japan

[73] Assignees: Hitachi, Ltd., Tokyo; Hitachi Software Engineering Co., Ltd., Yokohama, both of Japan

[21] Appl. No.: 318,249

[22] Filed: Mar. 3, 1989

Related U.S. Application Data

[63] Continuation of Ser. No. 63,104, Jun. 17, 1987, Pat. No. 4,831,368.

[30] Foreign Application Priority Data

Jun. 18, 1986 [JP] Japan ..... 61-142614

[51] Int. Cl.[5] ..... G09G 5/00

[52] U.S. Cl. ..... 340/720; 340/723; 340/724; 340/727; 382/46

[58] Field of Search ..... 340/720, 700, 723, 724, 340/727, 789, 798, 799; 382/44, 45, 46

[56] References Cited

U.S. PATENT DOCUMENTS

| | | | |
|---|---|---|---|
| 4,168,488 | 9/1979 | Evans | 340/727 |
| 4,225,929 | 9/1980 | Ikeda | 340/727 |
| 4,267,555 | 5/1981 | Boyd et al. | 340/727 |
| 4,527,155 | 7/1985 | Yamaki et al. | 340/727 |
| 4,542,377 | 9/1985 | Hagen et al. | 340/727 |
| 4,636,783 | 1/1987 | Omachi | 340/727 |
| 4,703,515 | 10/1987 | Baroody, Jr. | 340/727 |
| 4,831,368 | 5/1989 | Masimo et al. | 340/727 |

*Primary Examiner*—Alvin E. Oberley
*Assistant Examiner*—Richard Hjerpe
*Attorney, Agent, or Firm*—Antonelli, Terry, Stout & Kraus

[57] ABSTRACT

An information processing system comprises a display apparatus having a display screen which can be held in position of either vertical elongation or lateral elongation. The information processing system provides the operator with messages necessary for operation. By detecting the position of elongation of the display screen, data for the messages are selectively rotated so as to be always displayed uprightly on the display screen.

16 Claims, 5 Drawing Sheets

VERTICAL ← ROTATION → HORIZONTAL

IMAGE DATA (NOT ROTATED FOR DISPLAY WHEN THE DISPLAY SCREEN IS ROTATED)

FUNCTIONAL MESSAGE DATA
(ROTATED FOR DISPLAY WHEN THE DISPLAY SCREEN IS ROTATED)

$B=\log_2 \lceil m \rceil$ $A=\log_2 \lceil \frac{m}{n} \rceil$

DISPLAY APPARATUS WITH ROTATABLE DISPLAY SCREEN

This is a continuation of application Ser. No. 063,104, filed June 17, 1987, now U.S. Pat. No. 4,831,368.

BACKGROUND OF THE INVENTION

1. Field of the Invention

This invention relates to a display apparatus and more particularly to a display apparatus having a unidirectionally elongated, rotatable display screen.

2. Description of the Related Art

The majority of information processing systems have a display apparatus utilizing a CRT, LCD or the like. The display apparatus has a display screen which is typically rectangular with corners rounded. With regard to display of information on the display screen, either a vertically elongated display or a laterally elongated display is preferred case by case. Such languages as Japanese, Chinese and Korean allow both vertical writing and lateral writing notations and they may sometimes be used properly to comply with the form, vertical elongation or lateral elongation, of the display screen.

Frequently, the information processing system incorporates the display apparatus and a print-out device in combination. In the case where information is edited on the display screen and thereafter printed by means of the print-out device, it is desirable that the display screen match the form of the printing paper.

When pictures are displayed on the laterally elongated screen of the CRT display apparatus and are desired to be printed on vertically elongated printing paper, characters are required to be rotated through 90°, rearranged and then outputted. A method proposed to this end, however, needs a memory of extremely large capacity for storage of image data as well as much processing time before outputting when executing the rotation and rearrangement by using software. Accordingly, another method has been proposed (Japanese Patent Publication No. 57-60671) wherein one frame is divided into many square regions and the rotation and rearrangement is effected for individual square regions. The division of the frame permits a reduction in memory capacity necessary for processing and a reduction in processing time. In this latter proposal, the memory image matrix is divided into a smaller matrix of more cells each having, for example, 8×8 bits. Laterally arranged cells of the small matrix are stored in laterally arranged registers and then transferred to and stored in vertically arranged registers, thereby completing rotation of image data.

In still another proposal, the display screen of the display apparatus is made rotatable to match the printing paper. The display apparatus may be used properly such that its display screen is held in a position of lateral elongation when the printing paper is used in a position of lateral elongation or its display screen is held in a position of vertical elongation when the printing paper is used in a position of vertical elongation.

SUMMARY OF THE INVENTION

An object of this invention is to provide a display apparatus with a rotatable display screen which can rotate display information so that image data may readily be displayed on the display screen held in position of either of the vertical elongation and lateral elongation and that functional messages may always be displayed uprightly.

Information to be displayed on the display screen of the display apparatus includes image data (for all of graphics, characters and marks) and functional messages for designating instructions and guidance to the operator.

If all of the information is rotated when the display screen is rotated, a picture of the functional messages, like a picture of the image data, lies 90° sideways on the display screen and the functional messages become difficult to read. Disadvantageously, in the past, it has never been thought of to rotate only the functional messages while refraining from rotation of the image data.

This problem can be solved by handling the image data independently of the functional message data.

A rotatable display screen type display apparatus according to an embodiment of the invention comprises an image display bit map memory (hereinafter referred to as an image BMM) and a functional message display bit map memory (hereinafter referred to as a message BMM) which is independent of the image BMM. When a laterally elongated picture is desired to be displayed on a display screen of a normally vertical type display apparatus, the display screen is rotated so as to be held in a position of lateral elongation, and the rotation of the display screen is detected so that image data may be displayed, without rotation, on the display screen and the contents of the message BMM may be 90° rotated in the direction reverse to the rotation of the display screen and thereafter written into a rotated bit map memory (hereinafter referred to as a rotated BMM). Thus, contents of the rotated BMM are always 90° rotated with respect to the contents of the message BMM. The contents of the rotated BMM and the contents of the image BMM are sequentially displayed. When a picture of vertical elongation is desired to be displayed, the display screen is not rotated and is held in position of vertical elongation and the contents of the message BMM and the contents of the image BMM are sequentially displayed. Since the functional message information can be displayed in the correct direction by merely laying the display screen sidewise, a picture of easy visibility to the user can be obtained and the operational capability can be improved.

These and other objects and advantages will become apparent by reference to the following description taken in conjunction with the accompanying drawings.

Figure 1:
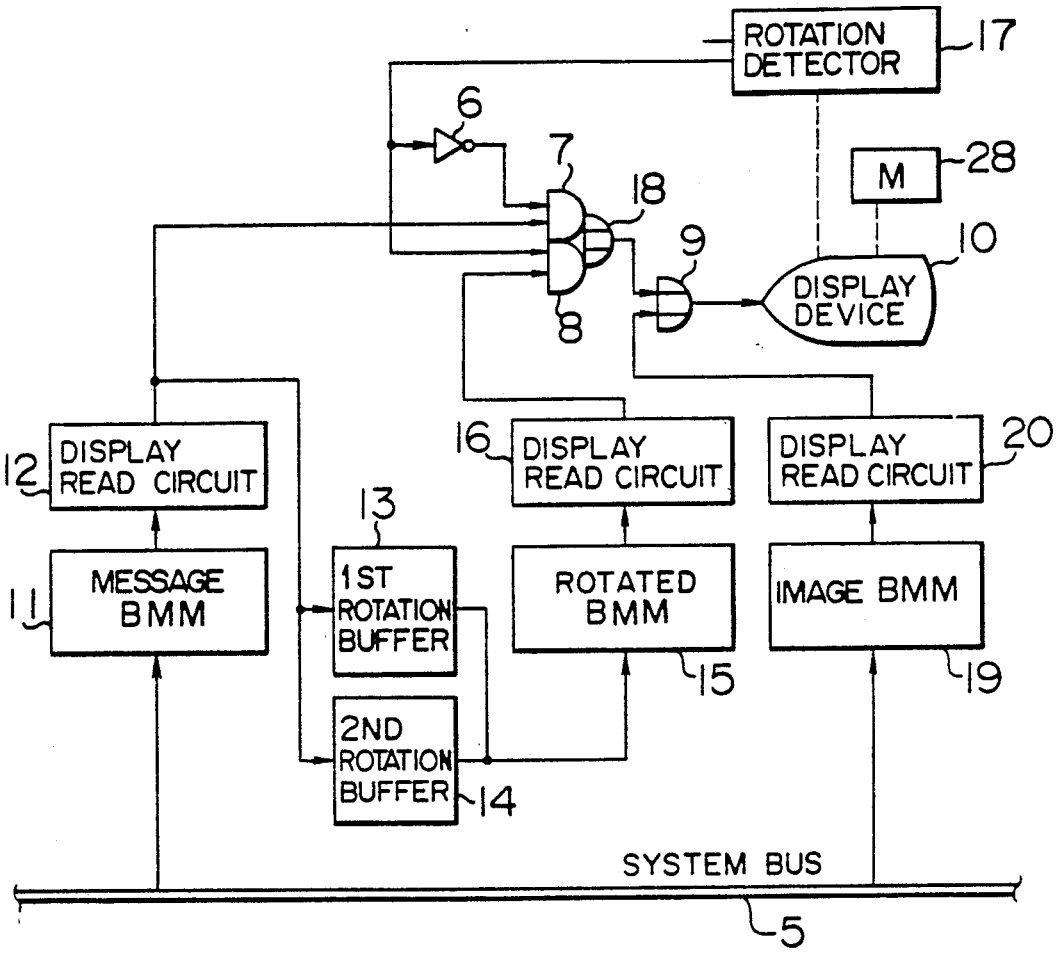
FIG. 1 is a block diagram showing a display apparatus with a rotatable display screen according to an embodiment of the invention.

In various Figures, reference numeral 5 designates a system bus, 6 an inverter, 7 and 8 AND gates, 9 an OR gate, 18 an exclusive OR gate, 11 a message BMM, 15 a rotated BMM, 19 an image BMM, 13 and 14 rotation buffers, 12, 16 and 20 display read circuits, 21 and 22 positions of vertical elongation and lateral elongation of the CRT display device, 41*a* to 41*d* registers, and 42 a selector.

DESCRIPTION OF THE PREFERRED EMBODIMENTS

Figure 2A:
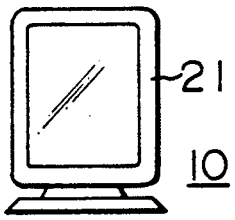
FIGS. 2A to 2F are schematic diagrams useful in explaining the rotational operation of a CRT display device in FIG. 1.
Figure 2B:
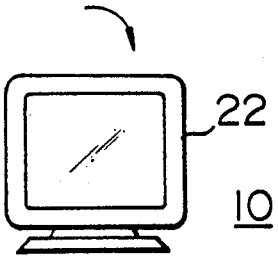
Figure 2C:
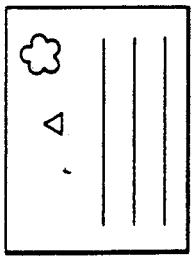
Figure 2D:
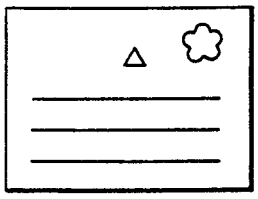

The invention will now be described by way of example with reference to the accompanying drawings, particularly, FIG. 1 illustrating, in block form, a display apparatus with a rotatable display screen according to an embodiment of the invention and FIGS. 2A to 2F illustrating the rotational operation of a CRT display device shown in FIG. 1. The CRT display device as designated by reference numeral 10 in FIG. 1 can be used properly with its display screen held in position of vertical elongation as shown at 21 in FIG. 2A or in position of lateral elongation as shown at 22 in FIG. 2B. The display screen of the CRT display device 10 can be rotated manually or by means of a driver such as a motor in compliance with the kind of display information. Specifically, the display screen is held in position of vertical elongation shown in FIG. 2A to conveniently handle a vertically elongated picture but is rotated to lateral elongation position shown in FIG. 2B to conveniently handle a laterally elongated picture. An example of display of image data is shown in FIGS. 2C and 2D, indicating that the display screen can be 90° rotated without rotating the image data relative to the display screen. For example, a picture for vertically elongated printing paper may conveniently be monitored on the vertically elongated display screen of FIG. 2C and a picture for laterally elongated printing paper may conveniently be monitored on the laterally elongated display screen of FIG. 2D.

Figure 2E:
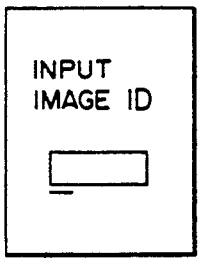
Figure 2F:
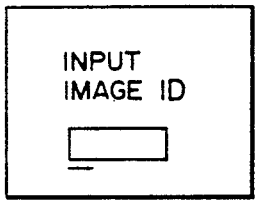

However, if message data used for conversation or message transmission (functional message data) between the information processing system and the operator are displayed similarly to the image data, then the functional message data will be displayed so as to lie sidewise on the display screen alternatively positioned as illustrated in FIG. 2C or 2D. Accordingly, the rotation of the display screen is detected by means of a rotation detector so that the functional message data can always be displayed uprightly as shown in FIGS. 2E and 2F.

Referring to FIG. 1, the cathode ray tube (CRT) type display device 10 is adapted to display on its display screen image data and functional message data. Functional message data per frame is stored in a message BMM 11 and read by means of a display read circuit 12 in synchronism with the display cycle. The message data read out of the message BMM 11 is alternately stored in first and second rotation buffers 13 and 14 which serve to rotate the message data and deliver rotated message data. The rotated message data delivered out of the first and second rotation buffers 13 and 14 are stored in a rotated BMM 15. In synchronism with the display cycle, a display read circuit 16 reads the message data from the rotated BMM 15 and supplies it to the display device 10. Image data per frame is stored in an image BMM 19 and read out of the image BMM 19 by means of a display read circuit 20 in synchronism with the display cycle. The display screen of the display device 10 is designed to be 90° rotatable through the use of a rotation mechanism 28. When the display screen is rotated to the lateral elongation position, a rotation detector 17 detects the rotation and produces a detection signal. A logic circuit is responsive to the detection signal to control display of the message data. More specifically, the detection signal is applied to an AND gate 8 while it is inverted by an inverter 6 into an inverting signal which is applied to an AND gate 7. With the detection signal being "1" indicative of rotation, the AND gate 8 is selected so that the data in the rotated BMM 15 can be passed through the AND gate 8 to an OR gate 18. With the detection signal being "0", the AND gate 8 is disabled for passage of data but the AND gate 7 is enabled by the inverting signal from the inverter 6 to pass the data in the message BMM 11. An exclusive OR gate 9 performs positive/negative control of display. In an alternative, the display read circuit 12 may also respond to the detection signal to select the destination of the read data. Transmission and reception of data between the display apparatus and peripheral units are effected through a bus 5.

As an example, the bus 5 is a 32-bit parallel data line, the image BMM 19 is a 512K-byte RAM, each of the message BMM 11 and rotated BMM 15 is a 128K-byte RAM, each of the rotation buffers 13 and 14 is a $(8\times8)$-bit, $(16\times16)$-bit or $(32\times32)$-bit register, and the display read circuit 12 reads $(8\times8)$-bit, $(16\times16)$-bit or $(32\times32)$-bit bit data, the data being commensurate with the size of the rotation buffers 13 and 14, from the message BMM 11 or reads data to be supplied to the AND gate 7. The read circuits 16 and 20 address the rotated BMM 15 and image BMM 19, respectively. The rotation mechanism 28 is driven by a motor to angularly reciprocate the display screen of the display device 10 through 90°. The rotation detector 17 comprises, for example, a microswitch which is actuated when the display screen of the display device 10 is held in position of lateral elongation. The above description is for illustrative purpose only and in no way limits the present invention.

The operation of the FIG. 1 display apparatus will now be described.

Firstly, when an image is desired to be displayed in vertically elongated form with the display screen of the CRT display device 10 held in the position of vertical elongation, the contents of the image BMM 19 are read by the display read circuit 20 and directly displayed on the display device 10. Contents of the functional message BMM 11 are read by the display read circuit 12 and passed through the AND gate 7 for being displayed on the CRT display device directly or without rotation. The contents of the message BMM 11 are also supplied to the rotation buffers 13 and 14, 90° rotated by the rotation buffers 13 and 14 and stored in the rotated BMM 15. Two stages of first and second rotation buffers 13 and 14 are used herein to ensure that while one of the rotation buffers 13 and 14 is reading data from the message BMM 11, the other can transmit data to the rotated BMM 15. This read and transmit operation is carried out alternately so that the other buffer is subsequently switched to read data with one buffer switched to transmit data to the rotated BMM, thereby permitting the 90° rotation to proceed smoothly.

When the display screen of the CRT display device 10 is 90° rotated by the rotation mechanism 28 so as to be held in the position of lateral elongation, the rotation detector 17 comprised of the microswitch detects the rotation and generates a signal indicative of rotation. This signal disables the AND gate 7 but enables the AND gate 8. As a result, the contents of the rotated BMM 15, that is, functional messages can be displayed on the CRT display device 10. Image data is read by the display read circuit 20 and directly displayed on the CRT display device 10.

More specifically, when the display screen of the CRT display device 10 is rotated by the rotation mechanism 28, the rotation detector 17 detects the rotation to produce the detection signal. Selection of the message BMM 11 when the display screen is held in position of vertical elongation and selection of the rotated BMM 15 when the display screen is held in position of lateral elongation are governed by the polarity of the detection signal. Thus, the rotation detection signal "1" causes the inverter 6 in FIG. 1 to produce the inverting signal "0" which in turn disables the AND gate 7 and consequently prevents passage of data read out of the message BMM 11. The AND gate 8 is enabled by the rotation detection signal "1" to pass data read out of the rotated BMM 15 to the OR gate 18. The data is then passed through the exclusive OR gate 9 and displayed on the CRT display device 10 in alternative or spatially separated relationship with display data read out of the image BMM 19 by the display read circuit 20.

Figure 3A:
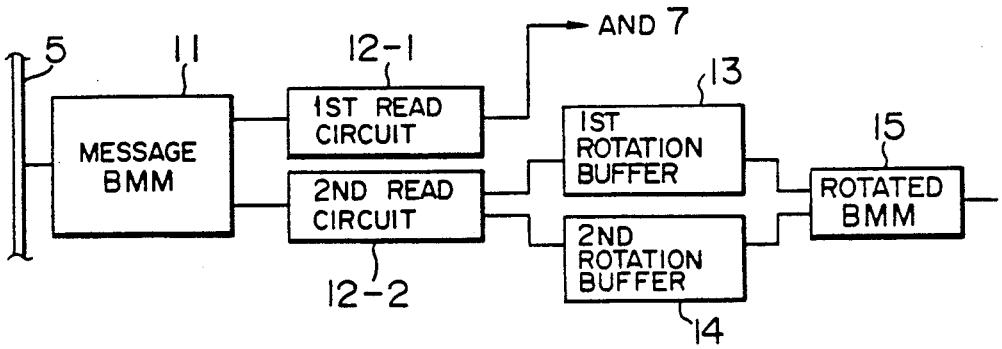
FIGS. 3A and 3B are diagrams for explaining the principle, based on which data in a message BMM shown in FIG. 1 are rotated and written into a rotated BMM shown in FIG. 1.

Transfer of data in the message BMM 11 to the rotated BMM 15 is specifically illustrated in a block diagram of FIG. 3A. A first read circuit 12-1 reads data from the message BMM 11 sequentially in the sequence of the scanning line and supplies it to the AND gate 7. A second read circuit 12-2 reads one by one square cells, each being of $(n \times n)$ bits, of a smaller matrix obtained by dividing the message BMM 11 and loads them on either one of the rotation buffers 13 and 14. Data is read out of the rotation buffer 13 or 14 in an order different from the order in which data is written into the rotation buffer 13 or 14, with the result that output data is 90° rotated relative to input data.

Figure 3B:
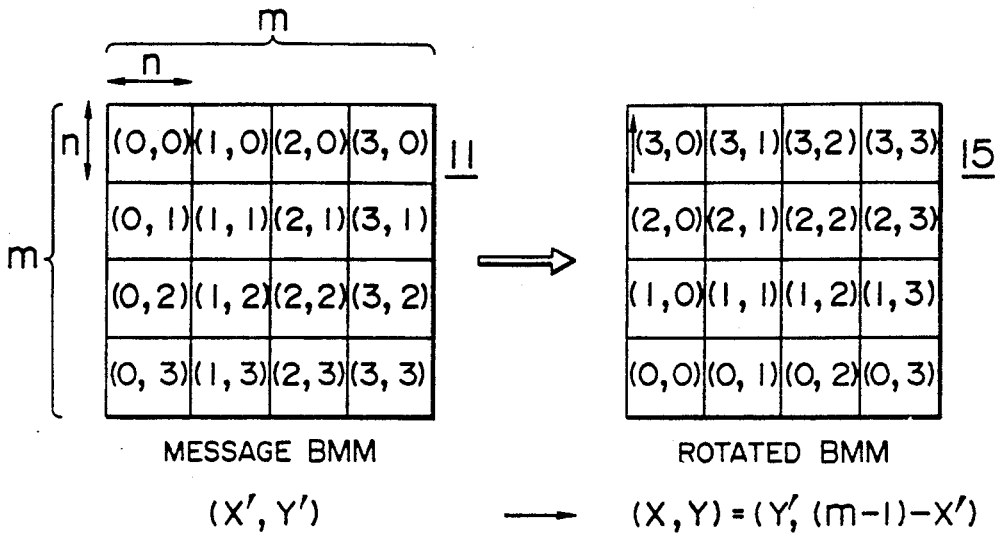

FIG. 3B illustrates a way of rotating transfer of data from the message BMM 11 to the rotated BMM 15. The transfer manner may be stipulated as described in Japanese Patent Publication No. 57-60671, which is incorporated herein by reference. The message BMM 11 is divided into a smaller matrix of $(m \times m)$ cells each being of $(n \times n)$ bits. In FIG. 3B, $m=4$ is assumed and n will be assumed to also equal 4 in the following description. The position of the cell of the small matrix is indicated by coordinates $(X', Y')$ in the message BMM, where $X'=0$ to $(m-1)$ and $Y'=0$ to $(m-1)$. By the rotation processing, a small matrix cell of coordinate $(X', Y')$ in the message BMM 11 is transferred to and stored at a cell of coordinates $(X, Y)=(Y', (m-1)-X')$ in the rotated BMM 15. In this manner, all of the cells of the small matrix can be rotated, thus enabling a right side in the message BMM, for example, to correspond to a top side in the rotated BMM. For example, a cell of coordinate (2, 1) in the message BMM is stored at a cell of coordinate $(1, 4-1-2)=(1, 1)$ in the rotated BMM after the rotation processing has been completed. This is indicated in FIG. 3B by the fact that (2, 1) at the coordinate (2, 1) in the message BMM is stored, after rotation, in the coordinate (1, 1) in the rotated BMM.

For transfer of the small matrix pursuant to FIG. 3B, the message BMM 11 may preferably be addressed such that data in individual cells is read out cell by cell.

Figure 4B:
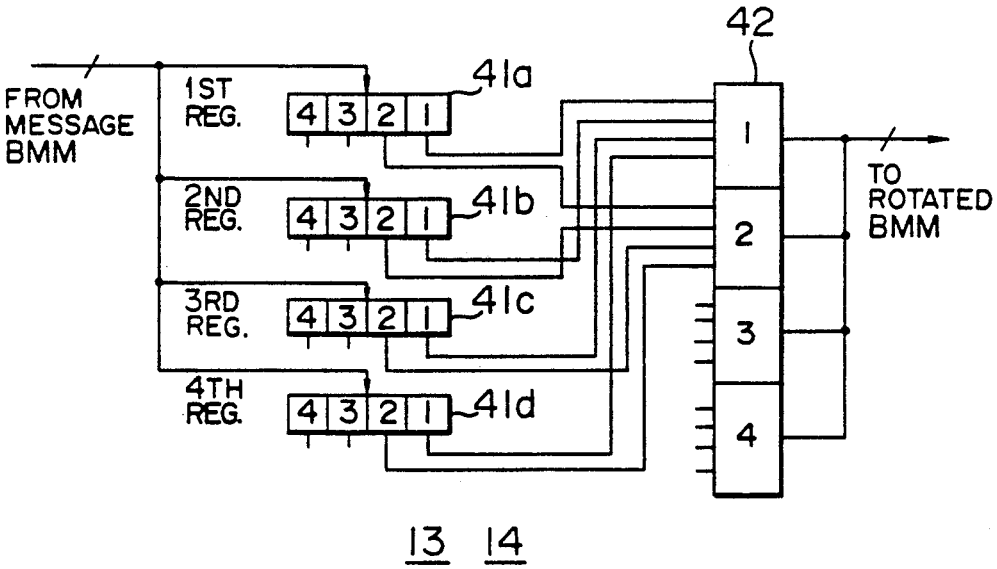
FIGS. 4A to 4C are diagrams showing specified arrangements for implementing the rotation and transfer of data as shown in FIG. 3.
Figure 4C:
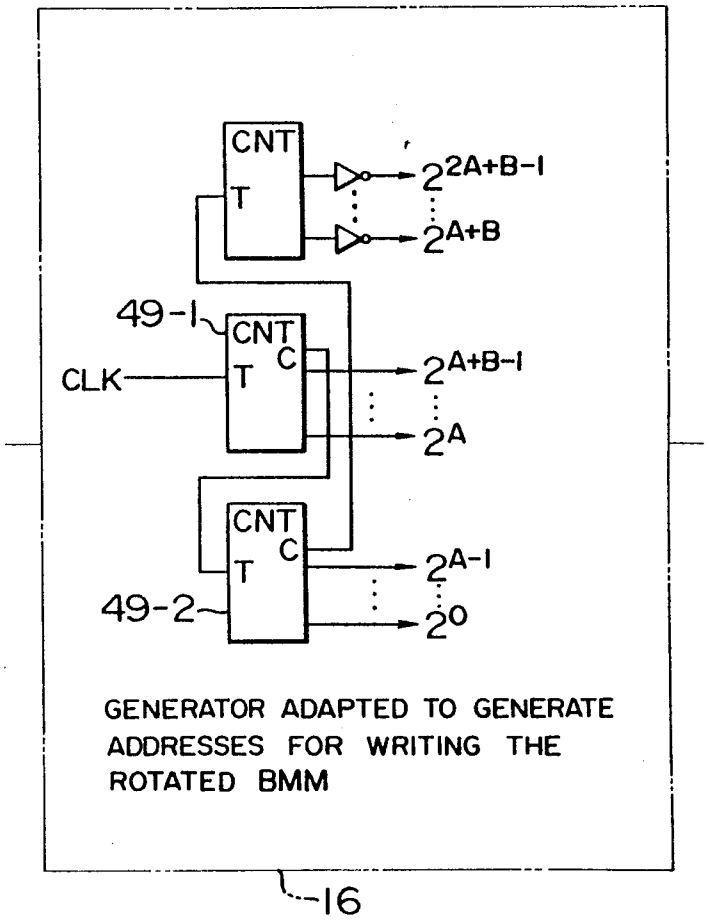
Figure 4A:
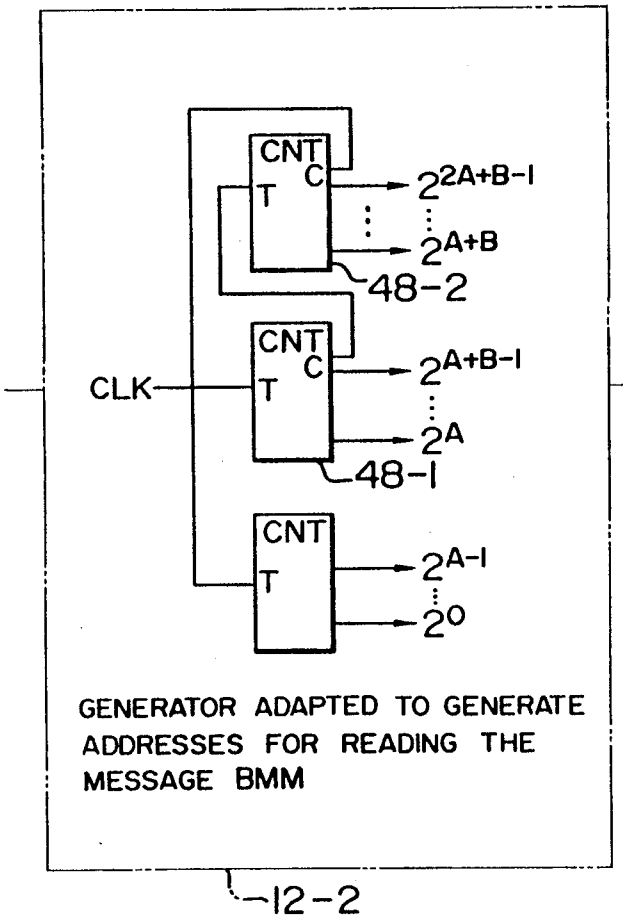

FIG. 4A shows a circuit adapted to generate addresses for reading the message BMM. A plurality of counters 48-1 and 48-2 sequentially count to provide addresses for data bits in individual cells. One counter can provide a series of addresses spaced at predetermined intervals.

The rotation buffer for storing data read out of the message BMM 11 as described above is exemplified in FIG. 4B. When considering $n=4$ in the small matrix of FIG. 3B, one cell contains $(4 \times 4)$ bits. Assuming that 4 bits arranged laterally in line constitute one word, there are 4 words arranged vertically. These 4 words are sequentially loaded on a first register **41*a*, a second register 41*b*, a third register 41*c* and a fourth register 41*d*, respectively, to write the $(4 \times 4)$-bit data in each cell of the small matrix into the first to fourth registers 41*a* to 41*d*. When reading these registers, 4 bits arranged vertically in line are treated as one word. Thus, four bits represented by 1's in the registers 41*a* to 41*d* are read as one word which is inputted to a port 1 of a selector 42, and four bits represented by 2's in the registers 41*a* to 41*d* are read as the following one word which is inputted to a port 2 of the selector 42. Similarly, 3's in the registers inputted to a port 3 of the selector 42 and 4's in the registers 41*a* to 41*d* to a port 4 of the selector 42. Thereafter, the data is outputted from the selector 42 sequentially in the order of ports 1, 2, 3 and 4** and written into the rotated BMM. In this manner, $(4 \times 4)$ bits in each cell of the small matrix can be rotated.

The rotated BMM 15 has a capacity of one frame and data in the small matrix read out of the rotation buffers 13 and 14 is stored at locations, as shown in the right-hand illustration of FIG. 3B, in the rotated BMM 15.

FIG. 4C shows a circuit adapted to generate addresses for writing the rotated BMM 15. Like the address generator circuit of FIG. 4A, a plurality of counters 49-1, 49-2, . . . count sequentially to provide addresses.

Figure 5:
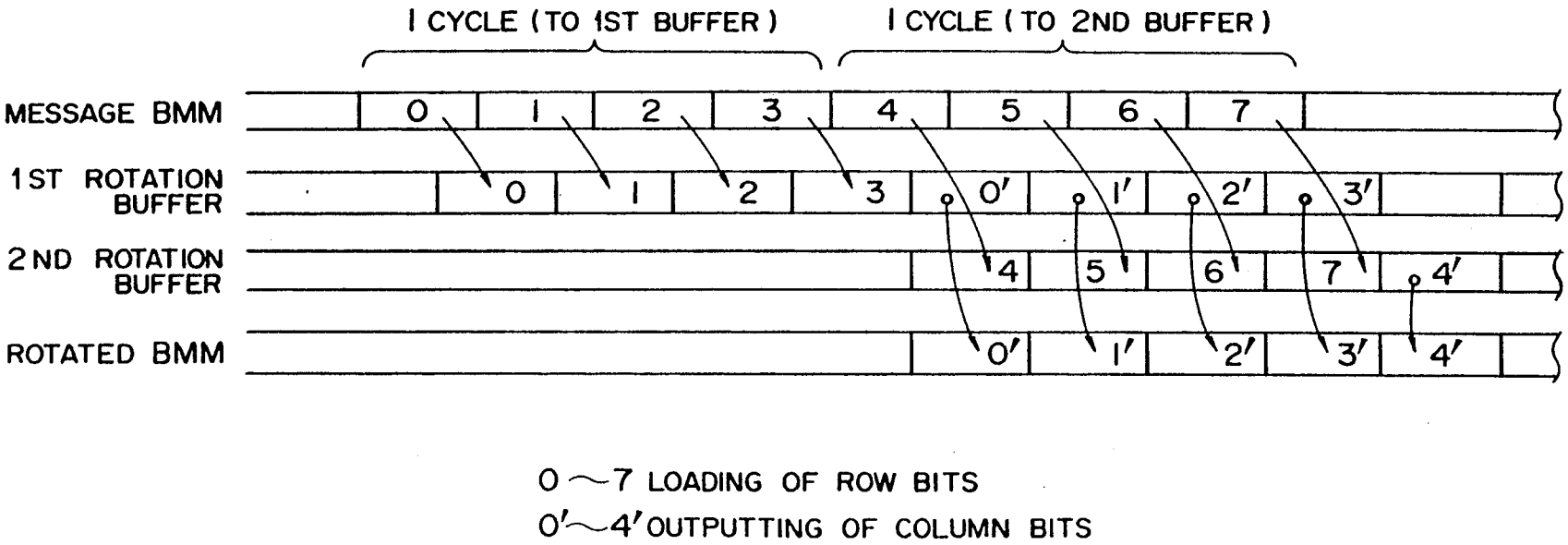
FIG. 5 is a time chart illustrative of the operation of rotation buffers shown in FIG. 4B.

FIG. 5 is a time chart illustrative of the operation of the first and second rotation buffers 13 and 14 shown in FIG. 1. Because of the provision of two stages of rotation buffer, the data input processing from the message BMM and the data output processing to the rotated BMM are carried out alternately and the rotation buffers are operated continuously. This permits the rotation processing to be performed real time. In FIG. 5, one word is indicated as one unit and four words constitute one small matrix cell. During the first cycle, one word represented by 0, 1, 2, 3 is transferred from the message BMM to the first rotation buffer and during the following cycle, one word represented by 4, 5, 6, 7 is transferred from the message BMM to the second rotation buffer and at the same time the one word represented by 0, 1, 2, 3 and stored in the first rotation buffer during the first cycle is transferred to the rotated BMM. During the further succeeding cycle (not shown), one word represented by 8, 9, 10, 11 is transferred from the message BMM to the first rotation buffer and concurrently therewith, the one word represented by 4, 5, 6, 7 and stored in the second rotation buffer is transferred to the rotated BMM. In FIG. 5, arrows associated with 0 to 7 indicate loading of row bits on the registers and arrows associated with 0' to 4' indicate outputting of column bits from the registers.

We claim:

1. In an information displaying apparatus, a method for displaying information on a rectangular display screen having short and long sides and which is supported for physical rotation between a first position in which said short side is elongated horizontally and a second position in which said long side is elongated horizontally, comprising the steps of:

providing first information indicating a message for operation of said information displaying apparatus;

providing second information indicating an image outputted selectively from a storage device for display on the display screen in an operation in accordance with the first information;

positioning the display screen in the first position;

displaying the first and the second information on the display screen when the display screen is positioned in the first position;

positioning the display screen in the second position;

rotating the first information by 90° in order to display rotated first information in a different direction of the display screen; and displaying the rotated first information and the second information on the display screen when the display screen is positioned in the second position.

2. An information displaying method according to claim 1, wherein the first information includes functional message information and the second information includes image data.

3. An information displaying method according to claim 1, wherein the display screen includes an image data displaying area and a message information displaying area, and the position of said message information displaying area is changeable according to the first or second position of the display screen.

4. An information displaying method according to claim 3, wherein the message information displaying area is arranged at a position where the message information is displayed horizontally when the display screen is both in the first and the second position.

5. An information displaying apparatus, comprising:

(a) a display device including a display screen having short and long sides;

(b) positioning means for positioning the short sides of the display screen to be directed horizontally in a first position and the long sides of said display screen to be directed horizontally in a second position by rotating the display device;

(c) a first memory means for storing first information which is displayed on the display screen;

(d) second memory means for storing second information which is displayed on the display screen; and (e) control means for mixing both the first information stored in the first memory means and the second information stored in the second memory means without rotation for display on the display screen when said display screen is positioned in the first position by the positioning means, and for mixing information which is obtained by rotating the first information stored in the first memory means by 90° and the second information stored in the second memory means for display on the display screen when the display screen is positioned in the second position by the positioning means.

6. An information displaying apparatus according to claim 5, wherein the first information is message information and the second information is image data.

7. An information displaying apparatus according to claim 5, wherein said control means always displays the first information horizontally regardless of whether the display screen is in the first or second position.

8. In information displaying apparatus, a method for displaying information on a rectangular display screen having short and long sides and which is supported for physical rotation between a first position in which said short side is elongated horizontally and a second position in which said long side is elongated horizontally, comprising the steps of:

providing first information forming a message for indicating operation of the display screen;

providing second information to be displayed on the display screen and which is stored in a memory having a large capacity and is selectively outputted from the memory by an operator according to the first information;

positioning said display screen at the first or second position by physical rotation thereof;

rotating the first information to provide rotated first information having a display direction on the display screen which is changed with respect to that of said first information;

selecting either the first information or the rotated first information in correspondence with the physical position of the display screen;

displaying the first information and the second information outputted from the memory on the display screen by synthesizing when the display screen is in the first position; and displaying the rotated first information and the second information outputted from the memory on the display screen by synthesizing when the display screen is in the second position.

9. A method for displaying information on a rectangular display screen according to claim 8, wherein the first information includes functional message information and the second information includes image data.

10. A method for displaying information on a rectangular display screen according to claim 8, wherein the display screen includes an image data displaying area and a message information displaying area, and the position of said message information displaying area is changeable according to the first or second position of the display screen.

11. A method for displaying information on a rectangular display screen according to claim 10, wherein the message information displaying area is arranged at a position where the message information is displayed horizontally when the display screen is both in the first and the second position.

12. An information displaying apparatus, for displaying information on a rectangular display screen having short and long sides and which is supported for rotation between a first position in which said short side is elongated horizontally and a second position in which said long side is elongated horizontally, comprising:

means for providing first information for showing a message for indicating operation of the display screen;

means for providing second information to be displayed on the display screen and which is stored in a memory having a large capacity and selectively outputted form the memory by an operator according to the first information;

means for positioning said display screen at the first or second position by physical rotation thereof;

means for rotating the first information to provide rotated first information having a display direction on the display screen which is changed with respect to that of said first information;

means for selecting the first information or the rotated first information in correspondence with the physical position of the display screen;

means for controlling said display screen to display the first information and the second information outputted from the memory on the display screen by synthesizing when the display screen is in the first position; and means for controlling said display screen to display the rotated first information and the second information outputted from the memory on the display screen by synthesizing when the display screen is in the second position.

13. An apparatus for displaying information on a rectangular display screen according to claim 12, wherein the first information includes functional message information and the second information includes image data.

14. An apparatus for displaying information on a rectangular display screen according to claim 12, wherein the display screen includes an image data displaying area and a message information displaying area, and the position of said message information displaying area is changeable according to the first or second position of the display screen.

15. An apparatus for displaying information on a rectangular display screen according to claim 14, wherein the message information displaying area is arranged at a position where the message information is displayed horizontally when the display screen is both in the first and second position.

16. A rotatable display screen type display apparatus, comprising:

first bit map memory means for storing image information;

second bit map memory means for storing functional message information with a first orientation and the same functional message information with a second orientation which differs from said first orientation;

a display device having a rotatable display screen for displaying image information and functional message information, said display screen being mounted for physical rotation between first and second orthogonal dispositions;

means for supplying said image information from said first bit map memory to said display device without changing the orientation of the supplied data regardless of the disposition of said display screen; and means connected to said second bit map memory means for selectively supplying functional information having either said first orientation of said second orientation from said second bit map memory means to said display device depending on whether said display screen is in its first or its second disposition, respectively.

* * * * *